US008909083B2

(12) United States Patent
Odaka

(10) Patent No.: US 8,909,083 B2
(45) Date of Patent: Dec. 9, 2014

(54) IMAGE FORMING APPARATUS AND CONTROL METHOD FOR FIXING HEATER

(71) Applicant: Kyocera Document Solutions Inc., Osaka (JP)

(72) Inventor: Yoshiyuki Odaka, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 21 days.

(21) Appl. No.: 13/800,093

(22) Filed: Mar. 13, 2013

(65) Prior Publication Data

US 2013/0243464 A1 Sep. 19, 2013

(30) Foreign Application Priority Data

Mar. 14, 2012 (JP) ..... 2012-057681

(51) Int. Cl.
*G03G 15/20* (2006.01)
*G03G 15/00* (2006.01)

(52) U.S. Cl.
CPC ..... *G03G 15/5004* (2013.01); *G03G 15/2039* (2013.01); *G03G 15/2078* (2013.01)
USPC ..... 399/67; 399/88

(58) Field of Classification Search
CPC ..... G03G 15/2039; G03G 15/2078; G03G 15/5004
USPC ..... 399/67, 88
See application file for complete search history.

(56) References Cited

U.S. PATENT DOCUMENTS

2009/0003868 A1* 1/2009 Namiki et al. ..... 399/69
2009/0074442 A1* 3/2009 Sano et al. ..... 399/69

FOREIGN PATENT DOCUMENTS

JP 05-038050 2/1993
JP 2002-268446 9/2002
JP 2005-017739 1/2005
JP 2013190675 9/2013

OTHER PUBLICATIONS

Japanese Office Action 2012-057681 dated Jun. 4, 2014, 3 pages.

* cited by examiner

*Primary Examiner* — Benjamin Schmitt
(74) *Attorney, Agent, or Firm* — K&L Gates LLP

(57) ABSTRACT

An image forming apparatus includes a fixing device including a heating roller heated by a fixing heater, a DUTY storage portion, a heater control portion, a number-of-times counting portion, a number-of-times determining portion, and a modifying portion. The DUTY storage portion stores a first DUTY table and a second DUTY table. The heater control portion reduces the consumption current of the fixing heater based on the first DUTY table when a total consumption current exceeds a setting current. The number-of-times counting portion counts the number of times the total consumption current has exceeded the setting current. The modifying portion causes the heater control portion to control the energization of the fixing heater based on the second DUTY table when the number-of-times determining portion determines that the number of times of excess exceeds a setting number of times.

10 Claims, 8 Drawing Sheets

601 601a

| COMPUTATIONAL DUTY VALUE | ··· | 55%~64% | 65%~74% | 75%~84% | ··· |
|---|---|---|---|---|---|
| USAGE DUTY VALUE | ··· | 60% | 70% | 80% | ··· |

← 600

602 602b 602a

FIG. 6A 604 604a

| COMPUTATIONAL DUTY VALUE | ··· | 55%~64% | 65%~74% | 75%~84% | ··· |
|---|---|---|---|---|---|
| USAGE DUTY VALUE | ··· | 57% | 67% | 77% | ··· |

← 603

605 605b 605a

FIG. 6B

IMAGE FORMING APPARATUS AND CONTROL METHOD FOR FIXING HEATER

INCORPORATION BY REFERENCE

This application is based upon, and claims the benefit of priority from the corresponding Japanese Patent Application No. 2012-057681, filed on Mar. 14, 2012, the entire contents of which are incorporated herein by reference.

BACKGROUND

The present disclosure relates to an image forming apparatus and a control method for a fixing heater. More particularly, the present disclosure relates to an image forming apparatus and a control method for a fixing heater, with which the consumption current of the fixing heater can be increased within a range not exceeding a setting current of a commercial power supply.

When, as in a multifunctional peripheral, an entire system including an image forming apparatus to which are connected peripheral devices, such as an image reading device (reader), a post-processing device (feeder), and a large-capacity paper feed device (option cassette), is used with a general commercial power supply, the current consumed by the entire system needs to be set so as not to exceed a predetermined value (e.g., 15 A in Japan). Therefore, the image forming apparatus and the peripheral devices are designed to hold their maximum consumption currents such that the total of the respective consumption currents of the image forming apparatus and the peripheral devices is not greater than a predetermined value.

When the image forming apparatus is a laser beam printer, for example, the electric power consumed by the thermal fixing device of the laser beam printer is maximum, and rated power of, e.g., a halogen heater serving as a heating unit of the thermal fixing device is held relatively low in some cases. The relatively low rated power of the heater creates problems in that a longer time is needed for warm-up, and image having a fixing failure may be outputted regardless of whether the peripheral devices are connected or not.

To solve the problems mentioned above, there is proposed an image forming apparatus including a consumption current detecting member for detecting the consumption current of one or more peripheral devices, a thermal fixing device for thermally fixing a toner image to a recording medium, and a temperature detecting member for detecting a temperature of the thermal fixing device. The proposed image forming apparatus also includes a power calculator for calculating, based on information regarding the consumption current of the peripheral devices and obtained by the consumption current detecting member, an allowable maximum power applied to a heater located in the thermal fixing device such that the total consumption current of the image forming apparatus and the peripheral devices is not greater than a predetermined value. The proposed image forming apparatus also includes an energization controller for controlling, based on the temperature detected by the temperature detecting member, energization of the heater within a range up to the allowable maximum applied power calculated by the power calculator such that the temperature of the thermal fixing device is kept at a predetermined temperature. With such a configuration, the current consumed by an entire system including the image forming apparatus and the peripheral devices, such as a reader, connected to the image forming apparatus can be held so as to be not greater than the predetermined value without prolonging the warm-up time by lowering the rated power of the heater. This results in advantageous effects that the relevant system can be operated with the general commercial power supply, and that images having a fixing failure can be avoided from being generated.

Furthermore, a fixing unit is located in the image forming apparatus, the fixing unit includes a heat roller, an induction heating coil for heating the heat roller, a current detector for detecting an input current. To supplied to the entirety of the image forming apparatus, and a fixing unit controller for controlling power supplied to the induction heating coil. When the input current Io detected by the current detector exceeds a setting current value Is, the fixing unit controller in the proposed fixing unit outputs, to a control unit of the image forming apparatus, a power (Ws−((Io−Is)×Vin) obtained by subtracting a power ((Io−Is)×Vin), which is the product of multiplying a voltage Yin supplied to the image forming apparatus by an excess current value (Io−Is), from a setting power Ws preset for supply to the fixing unit. By being given that the power (Ws−((Io−Is)×Vin) output from the fixing unit controller, the control unit of the image forming apparatus outputs a power control signal representing a value of the given power to the fixing unit controller, causing the fixing unit controller to control power supplied to the induction heating coil, to thereby perform control such that the input current Io does not exceed the setting current value Is. Thus, the current consumed by the entire apparatus can be controlled such that it does not exceed a prescribed current value, by detecting the input current to the image forming apparatus and by controlling the power supplied to the fixing unit, which consumes a large current.

Moreover, there is proposed a control device for an image forming apparatus, the control device includes a current detecting member for detecting a first total current value in a particular system of power supply equipment, the particular system including the image forming apparatus, a predictor for predicting a current value used by the image forming apparatus, and a calculator for calculating a second total current value based on the first total current value and the predicted current value. The proposed control device also includes a comparison member for comparing a current capacity of the particular system of the power supply equipment and the second total current value, and operation controller for causing the image forming apparatus to execute particular processing depending on a comparison result of the comparison member such that a circuit breaker is not turned off. Thus, the proposed control device allows only the particular processing to be executed by previously predicting the occurrence of a problem due to an overcurrent at such a level as turning off the circuit breaker, and by effectively distributing the limited power so as to avoid the occurrence of the problem. Hence it is possible to prevent troubles caused by frequent turning-off of the circuit breaker while ensuring safety.

As discussed above, the energization control for the fixing device in the image forming apparatus is executed as a control for keeping the temperature of the fixing heater constant. However, when a fixing process is performed on a certain sheet, the sheet draws heat. Accordingly, under setting conditions to execute the image forming process on a large number of sheets per unit time, particularly, the energization control is preferably performed on the fixing heater as far as up to an allowable maximum limit during the execution of the image formation.

In addition, the energization control is usually required to be performed within a range that such the total consumption current consumed by the entire image forming apparatus does not exceed the setting current (rated current 15 A) of the commercial power supply. To that end, in the above-described image forming apparatus, the total consumption current is detected or predicted, and when the total consumption current exceeds a predetermined setting current, the consumption current of the fixing heater is controlled to be reduced for a certain time.

Meanwhile, as mentioned above, various peripheral devices consuming currents are connected to the image forming apparatus in many cases. When a punching or stapling operation is executed in a post-processing device among the peripheral devices, the consumption current of the relevant peripheral device temporarily increases to a great extent and the total consumption current of the image forming apparatus temporarily increases. Depending on not only the types of circuits incorporated in the image forming apparatus and the peripheral devices, but also the type of power distribution environment of the commercial power supply, the total consumption current of the image forming apparatus may also temporarily increase during execution of the image formation due to other causes than the punching or stapling operation.

In such a case, as described above, the consumption current of the fixing heater is controlled to be reduced for a certain time. However, the reduction in the consumption current of the fixing heater directly leads to a temperature drop of the fixing heater. This may cause a problem of degradation in fixing property (i.e., quality of a formed image). If a process of reducing a sheet conveying speed is executed, for example, to deal with the problem of degradation in fixing property, the process naturally raises another problem of reducing a throughput of the entire image forming apparatus.

On the other hand, except for the period during which the total consumption current of the image forming apparatus temporarily increases, the consumption current of the fixing heater needs to be maintained at as great a level as possible, because the total consumption current is comparatively low.

SUMMARY

According to an embodiment of the present disclosure, there is provided an image forming apparatus including a fixing device, a DUTY storage portion, a heater control portion, a number-of-times counting portion, a number-of-times determining portion, and a modifying portion. The fixing device includes a heating roller heated by a fixing heater and a fixing roller brought into pressure contact with the heating roller. The fixing device fixes a toner image to a recording medium by the heating roller and the fixing roller. The DUTY storage portion stores a first DUTY table and a second DUTY table. In the first DUTY table, DUTY values are set in plural stages. In the second DUTY table, DUTY values less than the corresponding DUTY values in the first DUTY table by a predetermined value, respectively, are set in plural stages. The heater control portion controls energization of the fixing heater. When the total consumption current supplied from a commercial power supply exceeds a setting current, the heater control portion reduces the consumption current of the fixing heater by controlling the energization of the fixing heater based on the first DUTY table stored in the DUTY storage portion. The number-of-times counting portion counts the number of times the total consumption current has exceeded the setting current. The number-of-times determining portion determines whether the number of times of excess counted by the number-of-times counting portion exceeds a setting number of times. The modifying portion causes the heater control portion to control the energization of the fixing heater based on the second DUTY table stored in the DUTY storage portion when the number-of-times determining portion determines that the number of times of excess exceeds the setting number of times.

According to another embodiment of the present disclosure, there is provided a control method for a fixing heater in an image forming apparatus that includes a fixing device including a heating roller heated by the fixing heater and a fixing roller brought into pressure contact with the heating roller, the fixing device fixes a toner image to an recording medium by the heating roller and the fixing roller, including the steps of: storing, in a DUTY storage, a first DUTY table and a second DUTY table; causing a heater control portion to control energization of the fixing heater, and also causing the heater control portion to, when the total consumption current supplied from a commercial power supply exceeds a setting current, reduce the consumption current of the fixing heater by controlling the energization of the fixing heater based on the first DUTY table stored in the DUTY storage; causing a number-of-times counting portion to count the number of times the total consumption current has exceeded the setting current; causing a number-of-times determining portion to determine whether the number of times of excess counted by the number-of-times counting portion exceeds a setting number of times; causing the heater control portion to control the energization of the fixing heater based on the second DUTY table stored in the DUTY storage when the number-of-times determining portion determines that the number of times of excess exceeds the setting number of times. In the first DUTY table, DUTY values are set in plural stages. In the second DUTY table, DUTY values less than the corresponding DUTY values in the first DUTY table by a predetermined value, respectively, are set in plural stages.

Additional features and advantages are described herein, and will be apparent from the following Detailed Description and the figures.

BRIEF DESCRIPTION OF THE FIGURES

FIG. 6A illustrates a first DUTY table according to an embodiment of the present disclosure;

FIG. 6B illustrates a second DUTY table in an embodiment of the present disclosure;

DETAILED DESCRIPTION

An image forming apparatus according to an embodiment of the present disclosure will be described below with reference to the drawings for understanding of the present disclosure. It is to be noted that the following embodiment is an example of the present disclosure and is not purported to limit the technical scope of the present disclosure. Furthermore, an alphabet "S" prefixed to each numeral in a flowchart implies a step.

The image forming apparatus, including a post-processing device, according to an embodiment of the present disclosure is described below.

Figure 1:
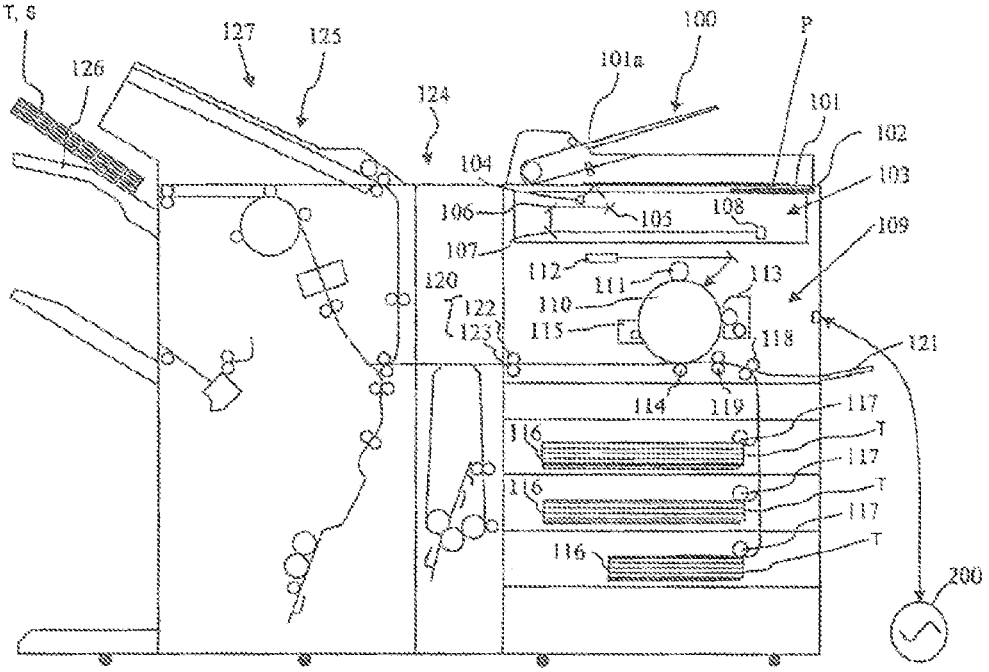
FIG. 1 illustrates an overall configuration of a multifunctional peripheral according to an embodiment of the present disclosure.

FIG. 1 illustrates an embodiment of an overall configuration of the image forming apparatus of the present disclosure. However, details of various portions not directly related to the present disclosure are omitted. The image forming apparatus of the present disclosure may be in the form of, e.g., a printer alone, a scanner alone, or a multifunctional peripheral having functions of a printer, a copier, a scanner, a fax, etc., and it functions as an image forming apparatus having, e.g., the copy function, the scanner function, the facsimile function, and/or the printer function.

Operation of a multifunctional peripheral 100 will be described in brief below in connection with the case where the copy function of the image forming apparatus is utilized.

First, a user turns on a power key of the multifunctional peripheral 100 connected to a commercial power supply 200, places an original document P on a platen 101 or an automatic document feeder 101*a*, which is located on an upper surface of the multifunctional peripheral 100, and inputs settings for the copy function via a console 102. An operating screen (e.g., an initial screen) related to the copy function provided by the multifunctional peripheral 100 is displayed on the console 102. Plural setting item keys related to the copy function are displayed on the operating screen in a selectable manner. The user inputs setting conditions related to the copy function via the operating screen. After inputting the setting conditions, the user pushes a start key located in the console 102, thus causing the multifunctional peripheral 100 to start processing of the copy function.

When the multifunctional peripheral 100 starts the processing of the copy function, light emitted from a light source 104 in an image reading unit 103 is reflected by the original document P placed on the platen 101. When plural sheets of original document P are placed on the automatic document feeder 101*a*, the automatic document feeder 101*a* feeds the sheets of original documents P to an image reading position in the image reading unit 103 one at a time. With the light source 104 emitting the light to the image reading position, the light is reflected by the original document P.

The reflected light is introduced to an image pickup element 108 through mirrors 105, 106 and 107. The light introduced to the image pickup element 108 is subjected to photoelectric conversion by the image pickup element 108 and further to basic image processing, including a correction process, an image quality process, and a compression process, whereby image data corresponding to the original document P is produced.

In an image forming unit 109, a toner image is formed from the image data. The image forming unit 109 includes a photosensitive drum 110. The photosensitive drum 110 rotates at a constant speed in a predetermined direction. Around the photosensitive drum 110, a charger 111, an exposure unit 112, a developing unit 113, a transfer unit 114, a cleaning unit 115, and so on are successively located, starting from the upstream side in the rotating direction of the photosensitive drum 110.

The charger 111 uniformly charges the surface of the photosensitive drum 110. The exposure unit 112 illuminates the charged surface of the photosensitive drum 110 with a laser based on the image data, thereby forming an electrostatic latent image. The developing unit 113 attaches toner to the electrostatic latent image formed as described above, and forms a toner image. The formed toner image is transferred onto a sheet T, e.g., a recording medium, by the transfer unit 114. The cleaning unit 115 removes extra toner remaining on the surface of the photosensitive drum 110 after the transfer. Such a series of processes are successively executed with rotation of the photosensitive drum 110.

The sheet T is fed from one of plural paper feed cassettes 116 located in the multifunctional peripheral 100. When the sheet T is fed, it is drawn out into a conveying path from one of the plural paper feed cassettes 116 by a pickup roller 117. Different types of sheets T are stored in the paper feed cassettes 116, respectively, and the correct sheet T is fed in accordance with information set in the setting conditions.

The sheet T drawn into the conveying path is introduced into a position between the photosensitive drum 110 and the transfer unit 114 by a conveying roller pair 118 and a registration roller pair 119. After the toner image has been transferred onto the sheet T by the transfer unit 114, the sheet T is fed to a fixing device 120. The sheet T to be fed by the conveying roller pair 118 may be fed from a manual feed tray 121 located in the multifunctional peripheral 100. The fixing device 120 includes a heating roller 122 heated by a fixing heater 204, and a pressing roller 123 held in pressure contact with the heating roller 122.

When the sheet T with the toner image transferred thereto passes between the heating roller 122 and the pressing roller 123 both located in the fixing device 120, a visible image is fixed to the sheet T using heat and pressure. The amount of heat applied from the heating roller 122 is optimally set depending on the type of the sheet T such that fixing of the visible image is properly performed. The image formation is completed upon the visible image being fixed to the sheet T, and the sheet T with the visible image fixed thereto is fed to a folding device 124 subsequent to the fixing device 120.

The thus-fed sheet T is subjected to a folding process by the folding device 124 in accordance with information set in the setting conditions having been inputted by the user. When the folding process is not inputted, the sheet T just passes through the folding device 124.

When the user inputs post-processing (e.g., binding such as stapling and punching) as one of the setting conditions, the sheet T having passed through the folding device 124 is fed to a binding device 125 where the post-processing is executed. As the post-processing, in the case of binding, for example, the binding device 125 executes punching on the plural sheets T in a punching unit (not illustrated), and stapling on all the sheets T in a stapling unit (not illustrated).

The individual sheets T or the bound sheets S having been subjected to the post-processing are stacked or stored in a paper output tray 126 of the binding device 125. The folding device 124 and the binding device 125 are collectively called a post-processing device 127 (finisher).

The multifunctional peripheral 100 provides the copy function to the user through the above-described procedures.

Figure 2:
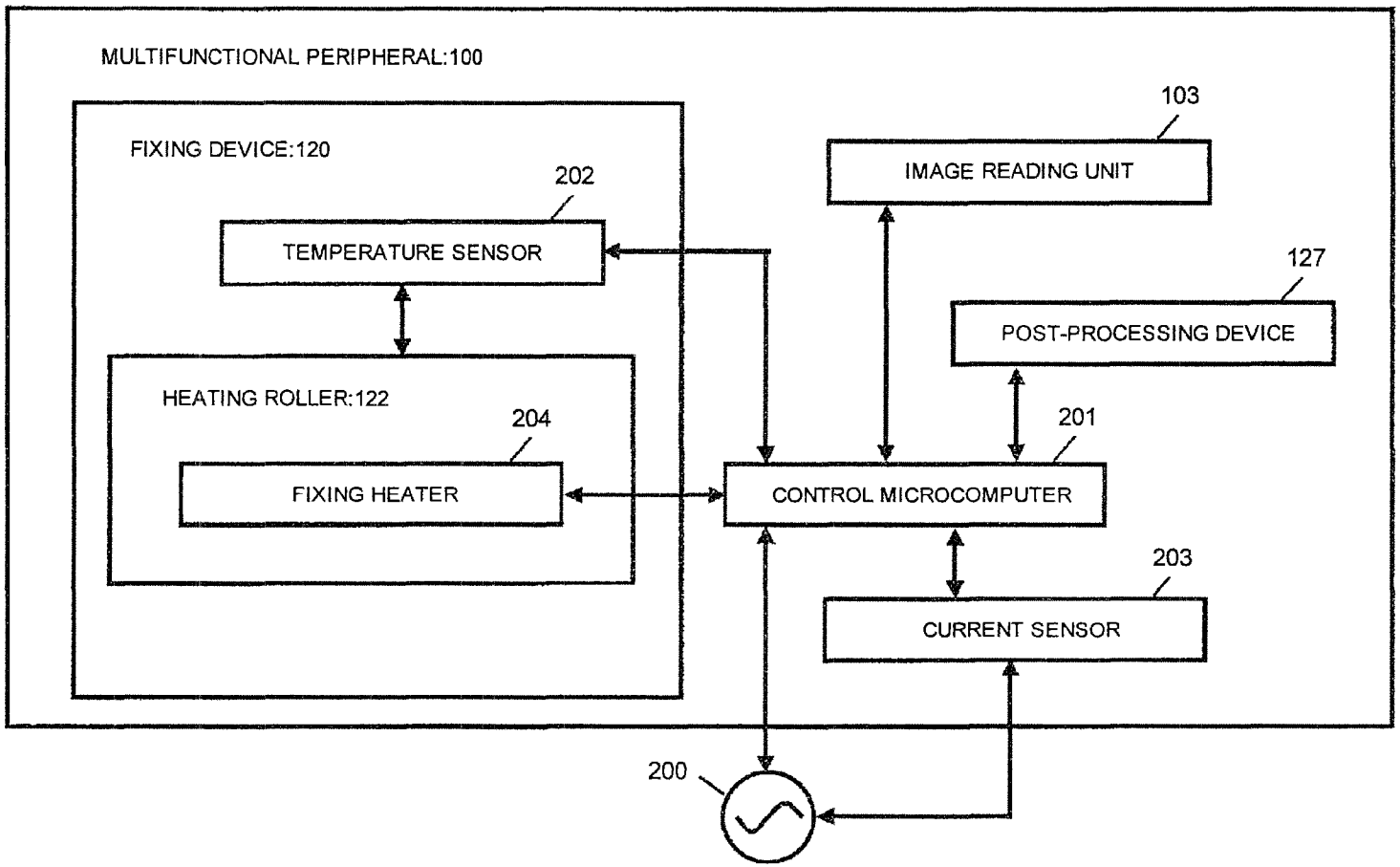
FIG. 2 illustrates a configuration of a fixing device in the multifunctional peripheral according to an embodiment of the present disclosure.

A configuration of the fixing device 120 in the multifunctional peripheral 100 will be described below with reference to FIG. 2. FIG. 2 illustrates the configuration of the fixing device 120 in the multifunctional peripheral 100 according to an embodiment of the present disclosure. However, details of various portions not directly related to the present disclosure are omitted.

As illustrated in FIG. 2, the fixing device 120 in the multifunctional peripheral 100 includes a control microcomputer 201 for controlling the fixing device 120. A temperature detected by and sent from a temperature sensor 202 (e.g., thermistor) and a current detected by and sent from a current sensor 203 are both inputted to the control microcomputer 201.

The temperature sensor 202 is located so as to contact the surface of the heating roller 122 in which the fixing heater 204 (e.g., a halogen heater) is built in, and it detects a temperature of the heating roller 122. The current sensor 203 is connected to the commercial power supply 200 for supplying power to the multifunctional peripheral 100 (including the control microcomputer 201), and it detects a current (total consumption current) corresponding to the power supplied to the multifunctional peripheral 100. The control microcomputer 201 determines (computes) a DUTY value necessary for heating the fixing heater 204, based on the temperature detected by using the temperature sensor 202, and further controls (turns on/off) supply of the power to the fixing heater 204 based on the determined DUTY value.

In addition to supplying the power to the fixing heater 204 at all times, the control microcomputer 201 further controls the supply of the power to other units, such as the image reading unit 103 and the post-processing device 127 in the multifunctional peripheral 100. When control microcomputer 201 supplies the power to those other units, the control microcomputer 201 monitors the total consumption current sent from the current sensor 203 and controls the DUTY value (as described in detail later) such that the total consumption current does not exceed a predetermined threshold (rated current).

Figure 3:
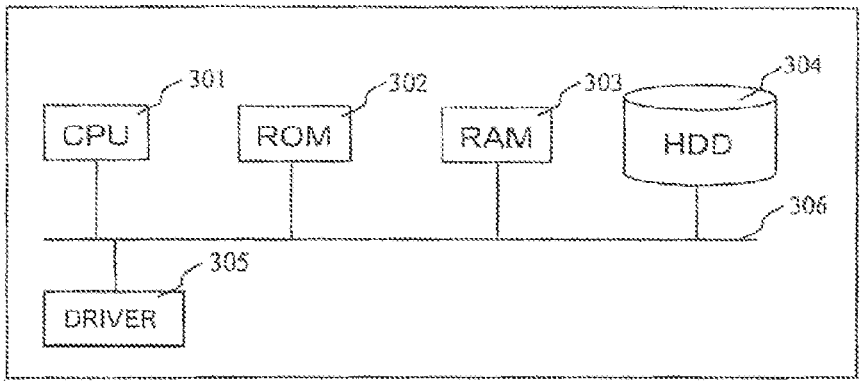
FIG. 3 illustrates a hardware configuration of a control system in the multifunctional peripheral according to an embodiment of the present disclosure.

A hardware configuration of a control system in the multifunctional peripheral 100 will be described below with reference to FIG. 3. FIG. 3 illustrates the hardware configuration of the control system in the multifunctional peripheral 100 according to an embodiment of the present disclosure. However, details of various portions not directly related to the present disclosure are omitted.

A control circuit of the multifunctional peripheral 100 includes a CPU (Central Processing Unit) 301, a ROM (Read Only Memory) 302, a RAM (Random Access Memory) 303, a driver 305 corresponding to each drive unit, a HDD (Hard Disk Drive) 304, which are interconnected via an internal bus 306.

The CPU 301 executes a program stored in, e.g., the ROM 302 or the HDD 304 while employing the RAM 303 as a working area, and further sends instructions to and receives data from the driver 305 based on the results of executing the program, thus controlling the operation of each of the drive units illustrated in FIGS. 1 and 2. In addition, the CPU 301 functions also as the above-mentioned control microcomputer 201.

Various portions (illustrated in FIG. 4) described below are implemented with the CPU 301 executing respective programs. The ROM 302 and the HDD 304 store the programs and data for implementing those various portions described below.

Figure 4:
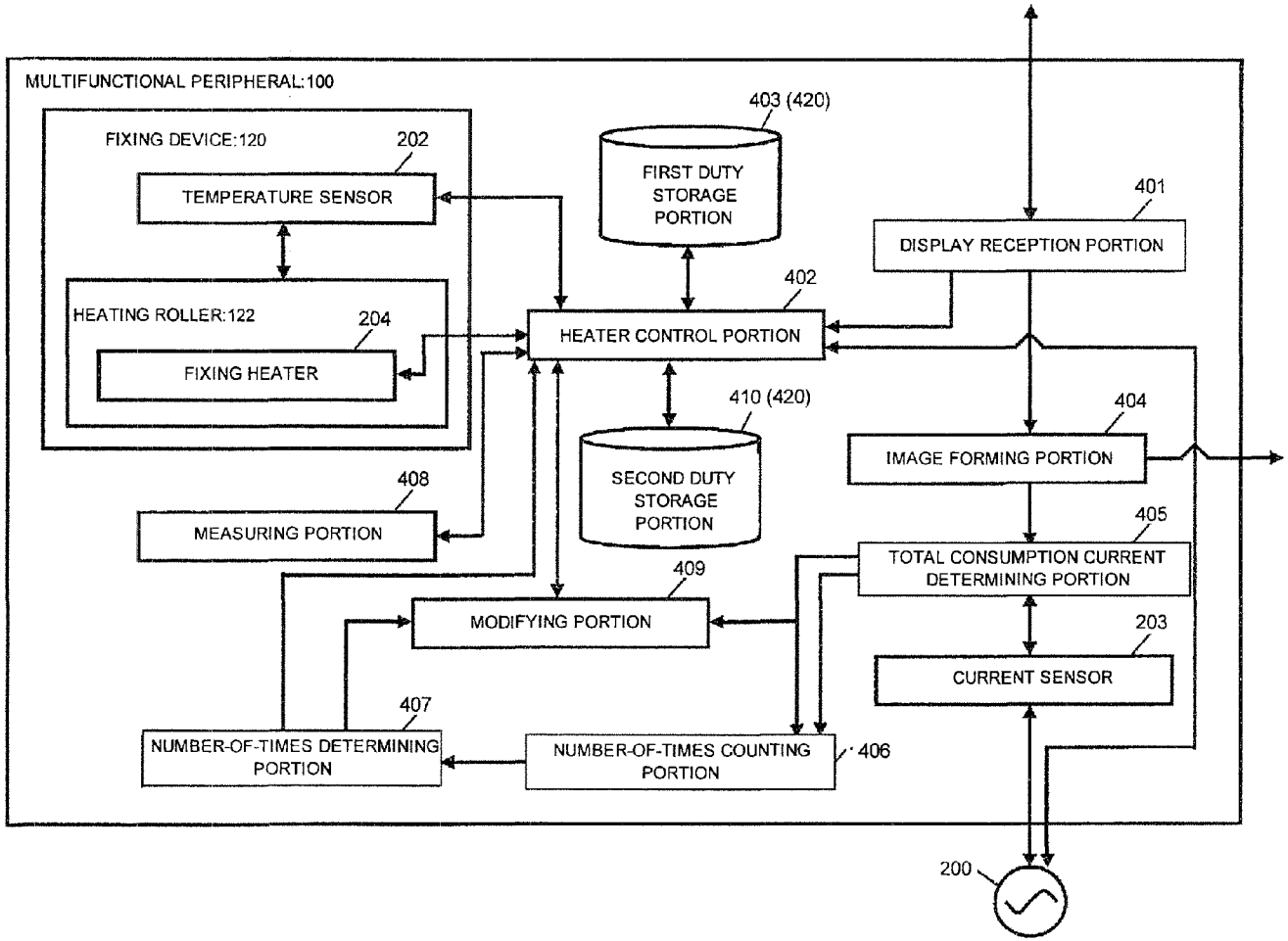
FIG. 4 is a functional block diagram of the multifunctional peripheral according to an embodiment of the present disclosure.
Figure 5:
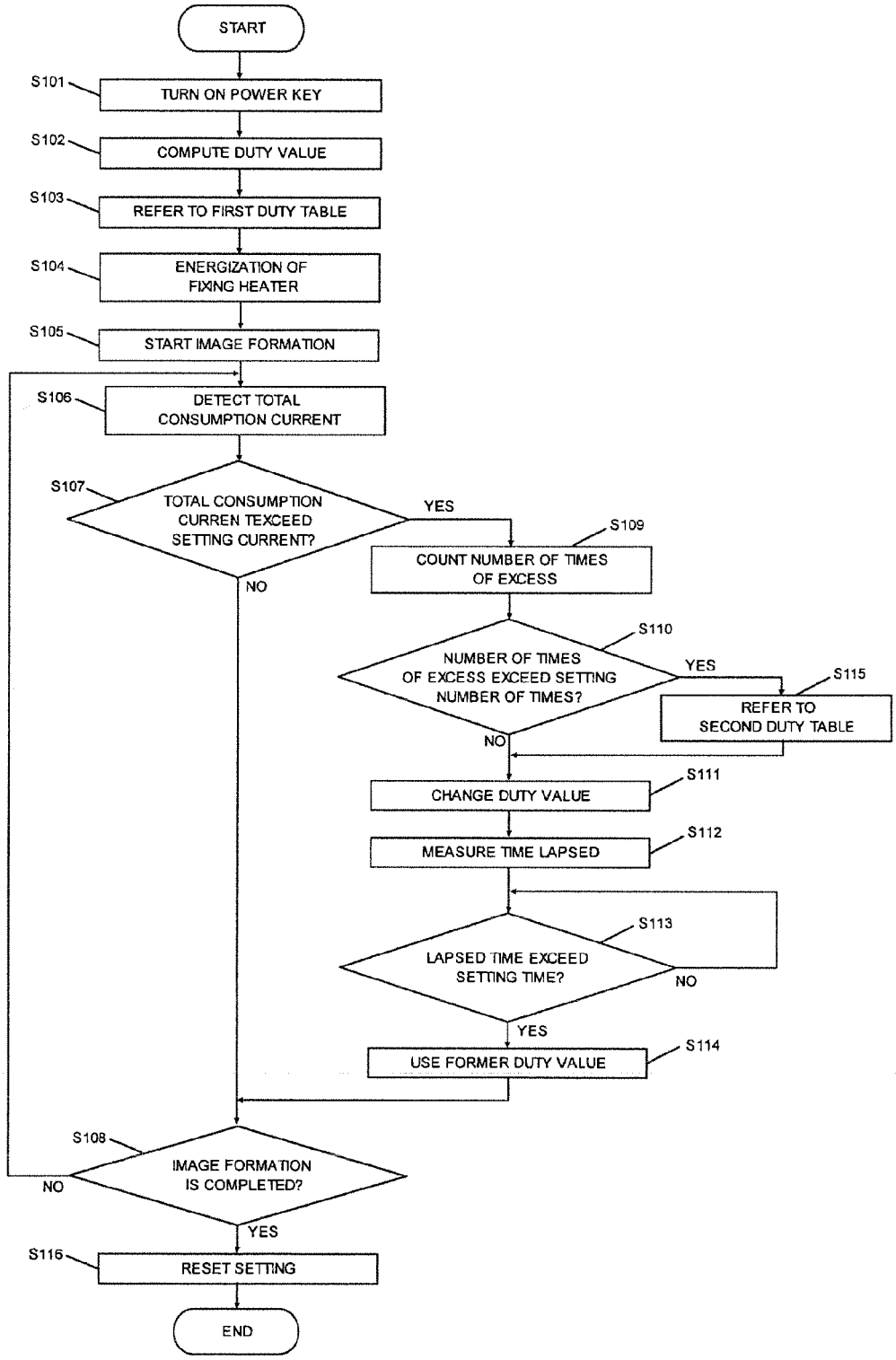
FIG. 5 is a flowchart illustrating execution procedures according to an embodiment of the present disclosure.

The configuration and the execution procedures according to an embodiment of the present disclosure will be described below with reference to FIGS. 4 and 5. FIG. 4 is a functional block diagram of the multifunctional peripheral 100 according to an embodiment of the present disclosure. FIG. 5 is a flowchart illustrating the execution procedures according to an embodiment of the present disclosure.

First, when the user turns on the power key of the multifunctional peripheral 100 connected to the commercial power supply 200 (FIG. 5: S101), a display reception portion 401 of the multifunctional peripheral 100 displays a predetermined setting condition screen via the console 102 and receives inputted predetermined setting conditions from the user.

Furthermore, upon the turning-on the power key, a heater control portion 402 of the multifunctional peripheral 100, which is supplied with power from the commercial power supply 200, obtains the temperature of the heating roller 122 from the temperature sensor 202 that contacts the heating roller 122 of the fixing device 120, and further computes a DUTY value (hereinafter called a "computational DUTY value") necessary for energizing the fixing heater 204 corresponding to the detected temperature (FIG. 5: S102). Then, the heater control portion 402 refers to a first DUTY table 600 in a first DUTY storage portion 403 (FIG. 5: S103).

As illustrated in FIG. 6A, the first DUTY table 600 stores, in a correlated way, preset ranges 601 (e.g., a range 601*a* (75% to 84%)) of the computational DUTY value and preset usage DUTY values 602 (e.g., a value 602*a* (80%)) corresponding respectively to the ranges 601 of the computational DUTY value.

Here, each of the usage DUTY values 602 represents a proportion of an energization time with respect to a preset period. When the usage DUTY value 602 is the value 602*a* (80%), the energization time (ON time) is 80% of the preset period, and a non-energization time (OFF time) is 20% of the preset period.

When the computational DUTY value (e.g., 81%) computed corresponding to the detected temperature is within one of the predetermined ranges 601 of the computational DUTY value (e.g., within the range 601*a* (75% to 84%)), the heater control portion 402 obtains one of the usage DUTY values 602 (e.g., the value 602*a* (80%)) corresponding to the relevant one of the ranges 601 of the computational DUTY value based on the first DUTY table 600. Then, the heater control portion 402 turns on and off the energization of the fixing heater 204 based on the obtained one of the usage DUTY values 602, thereby heating the fixing heater 204 (FIG. 5: S104).

With the start of the heating as mentioned above, the heater control portion 402 raises the temperature of the heating roller 122 to a predetermined temperature (e.g., 160° C.) and repeats the process of computing the computational DUTY value again based on the temperature detected by using the temperature sensor 202, referring to the first DUTY table 600, and controlling the energization of the fixing heater 204 based on the obtained usage DUTY value. Thus, the fixing temperature is maintained at the predetermined temperature.

When the user places an original document P on the platen 101 of the multifunctional peripheral 100, inputs intended setting conditions (e.g., 10 copies and punching), and presses the start key, the display reception portion 401 receives the setting conditions and the pressing of the start key, and further notifies those matters to an image forming portion 404 that corresponds to both the image forming unit 109 and the control microcomputer 201. Upon receiving the notification, the image forming portion 404 starts the image formation in accordance with the input setting conditions (FIG. 5: S105).

In more detail, the image forming portion 404 executes the operations to read image data from the original document P placed on the platen 101, and to form an image on the sheet T based on the read image data. Moreover, the image forming portion 404 operates the post-processing device 127 (e.g., punching) corresponding to the setting conditions, to thereby execute the intended post-processing (punching) on the sheet T after the image formation.

In parallel, at the time when the image forming portion 404 starts the image formation, the start of the image formation is notified to a total consumption current determining portion 405. Upon receiving the notification, the total consumption current determining portion 405 detects (obtains) the total consumption current, consumed by the multifunctional peripheral 100, via the current sensor 203 connected to the commercial power supply 200 (FIG. 5: S106).

Next, the total consumption current determining portion 405 determines whether the detected total consumption current exceeds a predetermined setting current (rated current of the commercial power supply 200, e.g., 15 A) that is set in advance (FIG. 5: S107).

If the determination result indicates that the total consumption current does not exceed the setting current (FIG. 5: "NO" in S107), the total consumption current determining portion 405 repeats the steps of, without executing other steps, detecting the total consumption current by using the current sensor 203 (FIG. 5: S106) and determining whether the detected total consumption current exceeds the setting current (FIG. 5: S107) (i.e., it monitors the total consumption current) until the image formation is completed (FIG. 5: as branched following "NO" in S108). Thus, the total consumption current determining portion 405 executes the above-described determination in parallel with the image formation by the image forming portion 404.

On the other hand, when the image forming portion 404 executes the operation of increasing the consumption current based on one of the setting conditions, e.g., the punching in the post-processing device 127, during the execution of the image formation, the current required to execute the punching is consumed. Therefore, as illustrated in the upper part of FIG. 7, the total consumption current 701 abruptly increases for a moment. As a result, the total consumption current 701 exceeds the setting current 702 for a moment at a point 703 in time.

If the determination result indicates that the total consumption current exceeds the setting current (FIG. 5: "YES" in S107), the total consumption current determining portion 405 notifies such an event of excess to a number-of-times count portion 406. Upon receiving the notification, the number-of-times count portion 406 adds "one" to the number of times N having been counted from the start point of the execution of the image formation, thereby counting the number of times N (hereinafter called the "number of times of excess") which represents that the total consumption current has exceeded the setting current from the start point of the execution of the image formation (FIG. 5: S109). It is to be noted that an initial value of the number of times N is set to "0".

When the number-of-times count portion 406 counts the number of times of excess N, it notifies the counted number of times of excess N to a number-of-times determining portion 407. Upon receiving the notification, the number-of-times count determining portion 407 determines whether the number of times of excess N exceeds the predetermined setting number of times (e.g., 4 or 10) that is set in advance (FIG. 5: S110).

If the determination result indicates that the number of times of excess N does not exceed the setting number of times (FIG. 5: "NO" in S110), the number-of-times determining portion 407 determines that a temporary abrupt increase of the total consumption current does not frequently occur, and it notifies such a determination result to the heater control portion 402. Upon receiving the notification, the heater control portion 402 refers to the first DUTY table 600, obtains the usage DUTY value 602 (e.g., a value 602*b* (70%)) that is one stage less than the currently-used usage DUTY value 602 (e.g., the value 602*a* (80%)), and turns on and off the energization of the fixing heater 204 based on the newly-obtained usage DUTY value 602 (e.g., the value 602*b* (70%)). Put another way, the number-of-times determining portion 406 changes (reduces) the usage DUTY value 602 and reduces the consumption current of the fixing heater 204 based on the usage DUTY value 602 (e.g., the value 602*b* (70%)) after the change (FIG. 5: S111)

Figure 7:
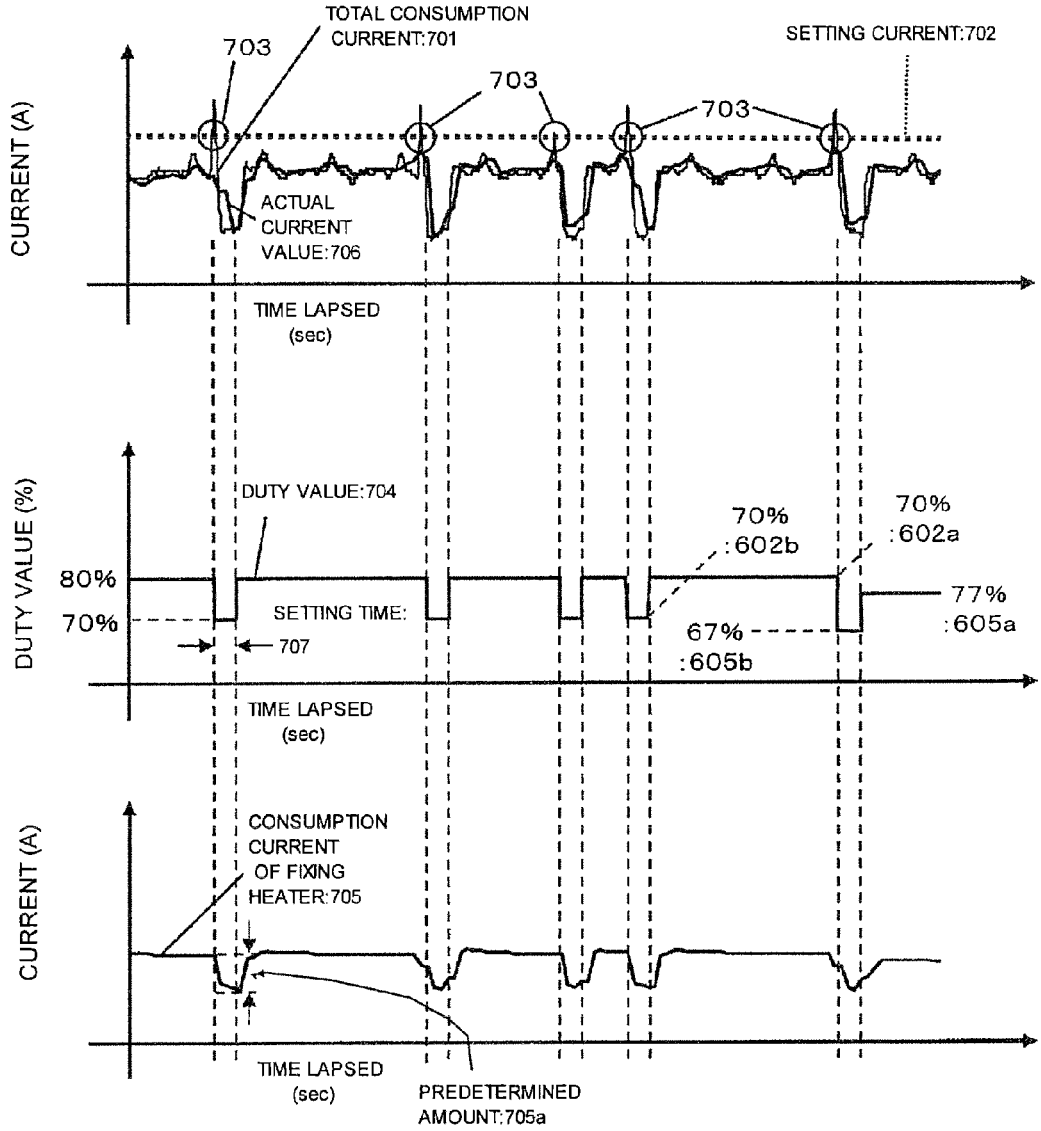
FIG. 7 depicts, in an upper pert thereof, change of the total consumption current and an actual current value over time in an embodiment of the present disclosure, in a middle pert thereof, change of a DUTY value over time according to an embodiment of the present disclosure and, in a lower pert thereof, change of a consumption current of a fixing heater over time in an embodiment of the present disclosure.

Thus, by reducing the usage DUTY value 704 from 80% to 70% as illustrated in the middle part of FIG. 7, the consumption current 705 of the fixing heater 204 can be reduced by a predetermined amount 705*a* as illustrated in the lower part of FIG. 7. Consequently, as illustrated in the upper part of FIG. 7, the actual total consumption current of the multifunctional peripheral 100, i.e., the actual current value 706, can be reduced and controlled such that the actual current value 706 is held within a range not exceeding the setting current 702 (15 A).

The above-mentioned detected total consumption current 701 and the actual current value 706 are quite different from each other. The detected total consumption current 701 is the current detectable by the current sensor 203, whereas the actual current value 706 represents the current actually consumed by the multifunctional peripheral 100. Put another way, the total consumption current 701 is given as the value resulting from detecting the current to be used in the multifunctional peripheral 100 at higher response than the actual current value 706. Therefore, even when the total consumption current 701 exceeds the setting current 702, this does not always imply that the actual current value 706 also exceeds the setting current 702. With the above-described energization control executed after the total consumption current 701 has exceeded the setting current 702, it is possible to control the actual current value 706 not to exceed the setting current 702 in some cases. In practice, the actual current value 706 requires to be held not larger than the setting current 702.

When the heater control portion 402 changes the usage DUTY value 602, such a change of the usage DUTY value 602 is notified to a measuring portion 408. Upon receiving the notification, the measuring portion 408 measures a time lapsed after the change of the usage DUTY value 602 (FIG. 5: S112). Then, the heater control portion 402 continues the turning-on and -off of the energization of the fixing heater 204 based on the usage DUTY value 602 after the change (FIG. 5: as branched following "NO" in S113) until the measured lapsed time reaches a predetermined setting time 707 (e.g., 30 msec) that is set in advance.

As a result, as illustrated in FIGS. 7B and 7C, the usage DUTY value 704 is reduced only during the setting time 707 to reduce the consumption current 705 of the fixing heater 204 by the predetermined amount 705*a* such that the actual current value 706 does not excessively increase (i.e., it does not exceed the setting current 702).

If the measured lapsed time exceeds the setting time (FIG. 5: "YES" in S113), the heater control portion 402 returns the usage DUTY value 602 after the change (e.g., the value 602*b* (70%)) to the usage DUTY value 602 before the change (e.g., the value 602*a* (80%)), (thus increasing the usage DUTY value 602). Then, the heater control portion 402 turns on and off the energization of the fixing heater 204 based on the former usage DUTY value 602 (FIG. 5: S114).

Thus, as illustrated in the middle part of FIG. 7, after the lapse of the setting time 707, the usage DUTY value 704 is returned to the former value, and the consumption current 705 of the fixing heater 204 is increased to raise the temperature of the heating roller 122 as high as possible. The above-described control is called "consumption current reducing control" hereinafter.

After the usage DUTY value 602 has returned to the former value, the control process shifts to S108, and the total consumption current determining portion 405 continues monitoring of the total consumption current (FIG. 5: S106 and S107) until the image formation is completed (FIG. 5: as branched following "NO" in S108).

When, as illustrated in the upper part of FIG. 7, the total consumption current 701 repeatedly exceeds the setting current 702 and the consumption current reducing control is repeatedly executed in S111 to S114 as described above during the execution of the image formation, the consumption current 705 of the fixing heater 204 is repeatedly reduced. With such a process, the actual total consumption current of the multifunctional peripheral 100, i.e., the actual current value 706, is intermittently reduced within a range not exceeding the setting current 702. However, the temperature of the heating roller 122 is intermittently lowered, thus degradation of the fixing property in the image formation or reduction of the overall productivity of the image formation may occur.

To deal with the above-mentioned problems, if the number of times of excess exceeds the setting number of times (four) in S110, the number-of-times determining portion 407 determines that the temporary abrupt increase of the total consumption current frequently occurs (i.e., that the above-mentioned consumption current reducing control frequently takes place), and it notifies such a determination result to a modifying portion 409. Upon receiving the notification, the modifying portion 409 causes the heater control portion 402 to control the energization of the fixing heater 204 based on a second DUTY table 603 in which usage DUTY values less than the corresponding usage DUTY values 602 in the first DUTY table 600 by a predetermined value (e.g., 3%), respectively, are set in plural stages, (thus reducing the consumption current).

Practically, the modifying portion 409 instructs the heater control portion 402 to refer to the second DUTY table that is stored in a second DUTY table storage portion 410 (FIG. 5: S115). The first DUTY storage portion 403 and the second DUTY storage portion 410 constitute a DUTY storage portion 420.

As illustrated in FIG. 6B, the second DUTY table 603 stores ranges 604 (e.g., a range 604*a* (75% to 84%)) of the computational DUTY value, which are similar to the ranges 601 of the computational DUTY value set in the first DUTY table 600, and usage DUTY values 605 (e.g., a value 605*a* (77%)), which correspond respectively to the ranges 604 of the computational DUTY value and which are less than the corresponding usage DUTY values 602 (e.g., the value 602*a* (80%)) set in the first DUTY table 600 by the predetermined value (3%).

By referring to the second DUTY table 603, the heater control portion 402 specifies one of the usage DUTY values 605 (e.g., the value 605*a* (77%)) in the second DUTY table 603, which corresponds to the currently-used one of the usage DUTY values 602 (e.g., the value 602*a* (80%)) in the first DUTY table 600. Moreover, the heater control portion 402 obtains, for additional modification, another usage DUTY value 605 (e.g., a value 605*b* (67%)) in the second DUTY table 603, which is one stage less than the specified one of the usage DUTY values 605 (e.g., the value 605*a* (77%)) (FIG. 5: S111), (thus changing the usage DUTY value 605 to be reduced). Then, the heater control portion 402 turns on and off the energization of the fixing heater 204 based on the modified usage DUTY value 605 (e.g., the value 605*b* (67%)) after the change.

Practically, as illustrated in the middle part of FIG. 7, when the number of times of excess N exceeds the setting number of times (four), the usage DUTY value 704 is reduced to the value 605*b* (67%)) in the second DUTY table 603 instead of being reduced to the value 602*b* (70%)) in the first DUTY table 600 in the ordinary case.

After the change to the modified usage DUTY value 605 (e.g., the value 605*b* (67%)) in S111, the heater control portion 402 turns on and off the energization of the fixing heater 204 based on the modified usage DUTY value 605 (e.g., the value 605*b* (67%)) for the setting time 707 measured by the measuring portion 408 (FIG. 5: S112 and S113).

After the lapse of the setting time (FIG. 5: "YES" in S113), the heater control portion 402 returns the modified usage DUTY value 605 (e.g., the value 605*b* (67%)) after the change to the usage DUTY value 605 (e.g., the value 605*a* (77%)) without the change, i.e., to the usage DUTY value 605 (e.g., the value 605*a* (77%)) that is one stage more than the modified usage DUTY value 605 (e.g., the value 605*b* (67%)) in the second DUTY table 603. Then, the heater control portion 402 turns on and off the energization of the fixing heater 204 based on the returned usage DUTY value (77%) (FIG. 5: S114). The process herein is executed based on the second DUTY table 603 (or the same DUTY table as the second DUTY table 603).

Practically, as illustrated in the middle part of FIG. 7, after the lapse of the setting time 707 in the case where the number of times of excess N has exceeded the setting number of times (four), the usage DUTY value 704 after the change is increased to the value 605*a* (77%) in the second DUTY table 603 instead of being increased to the value 602*a* (80%) in the first DUTY table 600 in the ordinary case.

As described above, when the temporary abrupt increase of the total consumption current frequently occurs, the energization control of the fixing heater 204 is executed by employing, as the basis for the energization control of the fixing heater 204, the second DUTY table 603 instead of the first DUTY table 600, and evenly reducing all of the usage DUTY values 602 by the predetermined value. As a result, the consumption current of the fixing heater 204 is reduced on the whole by a predetermined amount.

Figure 8:
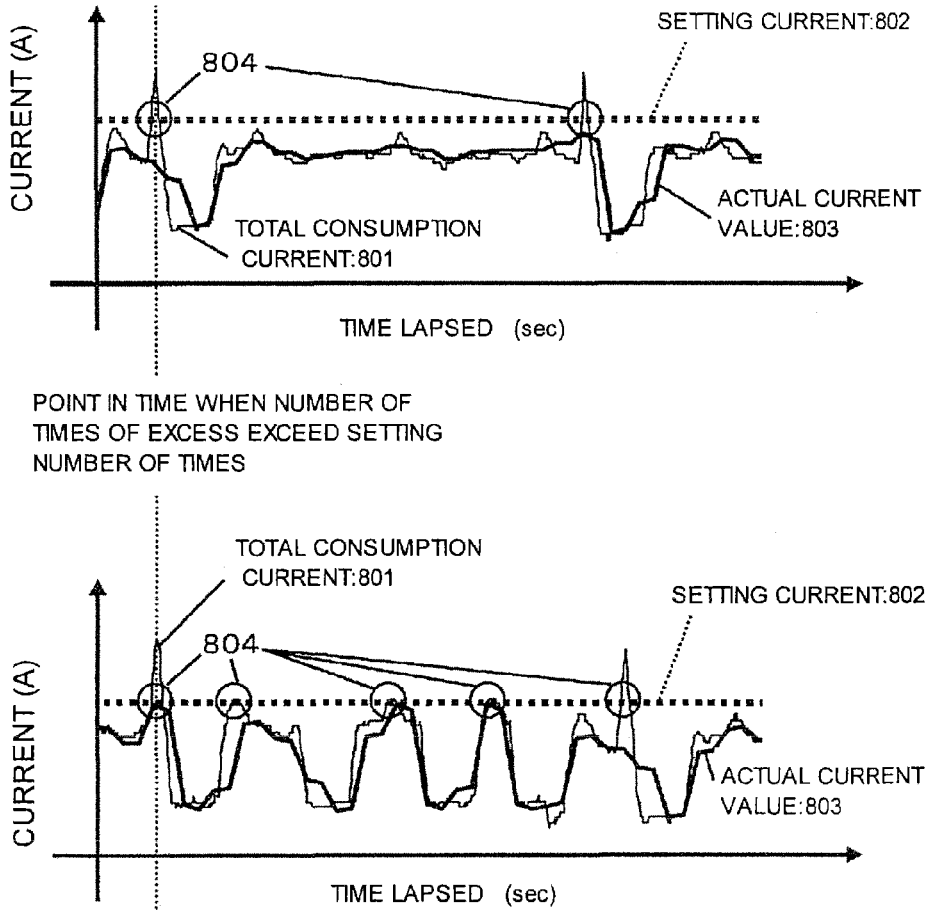
FIG. 8 depicts, in an upper pert thereof, change of the total consumption current and an actual current value over time in an embodiment of the present disclosure when the second DUTY table is used, and, in a lower part thereof, change of a total consumption current and an actual current value over time in the embodiment of the present disclosure when the first DUTY table is used.

Thus, as illustrated in the upper part of FIG. 8, after a temporary abrupt increase of a total consumption current 801 has occurred frequently (e.g., after frequent execution of the punching), it is possible to reduce the frequency that the total consumption current 801 may exceed the setting current 802 thereafter, because the consumption current of the fixing heater 204 is reduced on the whole.

More specifically, as illustrated in the upper part of FIG. 8, since the fixing heater 204 is controlled based on the second DUTY table 603 after the number of times of excess N has exceeded the setting number of times, a frequency 804 at which the total consumption current 801 exceeds the setting current 802 during a predetermined period is reduced to one.

On the other hand, as illustrated in the lower part of FIG. 8, if the fixing heater 204 is controlled based on the first DUTY table 600 after the number of times of excess N has exceeded the setting number of times, the frequency 804 at which the total consumption current 801 exceeds the setting current 802 during the same period as that in the upper part of FIG. 8 is four.

The above results show that the frequency 804 in the case performing the energization control based on the second DUTY table 603 is less than the frequency 804 in the case performing the energization control based on the first DUTY table 600.

In more detail, if the energization control based on the first DUTY table 600 is continued, the total consumption current 801 repeatedly exceeds the setting current 802, and the consumption current reducing control is repeatedly executed as in S111 to S114 described above. Accordingly, as illustrated in the lower part of FIG. 8, an actual total consumption current of the multifunctional peripheral 100, i.e., an actual current value 803, is intermittently reduced although it does not exceed the setting current 802. As a result, the temperature of the heating roller 122 is intermittently lowered, thus degradation of the fixing property in the image formation, or reduction of the overall productivity of the image formation may occur.

In contrast, by switching over to the energization control to be performed based on the second DUTY table 603 and by controlling the fixing heater 204 based on the second DUTY table 603, the actual total consumption current of the multifunctional peripheral 100, i.e., the actual current value 803, is maintained for a comparatively long time at a value, which does not exceed the setting current 802 and which is close to the setting current 802. As a result, the heating of the fixing heater 204 can be continued, and a temperature drop of the heating roller 122 due to an increase of the frequency 804, i.e., the need of executing the consumption current reducing control, can be minimized. It is therefore possible to stabilize the energization control of the fixing heater 204, and to overcome the degradation of the fixing property in the image formation, or the reduction of the overall productivity in the image formation.

After the return of the usage DUTY value 605 (FIG. 5: S114), the total consumption current determining portion 405 shifts to S108 and monitors the total consumption current (FIG. 5: S106 and S107) until the image formation is completed (FIG. 5: as branched following "NO" in S108), like the above-described case.

Once the heater control portion 402 controls the energization of the fixing heater 204 based on the second DUTY table 603, the heater control portion 402 continues to control the energization of the fixing heater 204 based on the second DUTY table 603 until the image formation is completed (FIG. 5: as branched following "NO" in S108).

If the image forming portion 404 completes the entire image formation (FIG. 5: "YES" in S108), the settings made during the execution of the image formation are reset (FIG. 5: S116). More specifically, the image forming portion 404 notifies the completion of the entire image formation to the modifying portion 409. Upon receiving the notification, the modifying portion 409 instructs the heater control portion 402 to refer to the first DUTY table 600. Accordingly, after the completion of the image formation, even when the heater control portion 402 has executed the control based on the second DUTY table 603 so far, the heater control portion 402 refers to the first DUTY table 600 as the DUTY table to be used in the control, and controls the energization of the fixing heater 204 based on the first DUTY table 600. Furthermore, when the heater control portion 402 has executed the control based on the first DUTY table 600 so far, the heater control portion 402 refers to the first DUTY table 600 again after the completion of the image formation regardless of the above-mentioned resetting, and controls the energization of the fixing heater 204 based on the first DUTY table 600.

In addition, the image forming portion 440 notifies the completion of the entire image formation to the number-of-times counting portion 406. Upon receiving the notification, the number-of-times counting portion 406 returns the number of times of excess N, which has been counted so far, to the initial value, i.e., 0 (zero).

In such a way, the energization control of the fixing heater 204 can be returned to the initial state. For example, when the setting conditions include the punching as described above, the number of times of excess N may be increased, but the above-mentioned frequency 804 can be reduced by controlling the energization of the fixing heater 204 based on the second DUTY table 603.

On the other hand, when the setting conditions are set to simple monochromatic copy, the number of times of excess N may not be increased. Additionally, the number of times of excess N varies to a large extent depending on, e.g., the type of the multifunctional peripheral 100, the type of the post-processing device 127, and situations in use of the commercial power supply at that time. In some cases, it is unknown that the number of times of excess N is increased in what state.

For that reason, after the completion of the image formation, the energization control of the fixing heater 204 is returned to the initial state. This ensures that only when the number of times of excess N is significantly increased, the energization control based on the second DUTY table 603 is employed, thus allowing the energization control to be performed based on the first DUTY table 600 as long as possible during the operation. Thus, a state capable of holding the temperature of the heating roller 122 comparably high on the whole is ensured, whereby the fixing property and the productivity can be improved.

As described above, the image forming apparatus of the present disclosure includes the number-of-times counting portion 406 for, whenever the total consumption current exceeds the setting current, incrementing the count of the number of times of excess N, the number-of-times determining portion 407 for determining whether the counted number of times of excess N exceeds the predetermined setting number of times, and the modifying portion 409 for, when the counted number of times of excess N exceeds the setting number of times, causing the heater control portion 402 to control the energization of the fixing heater 204 based on the second DUTY table 603 in which the usage DUTY values 605 less than the corresponding usage DUTY values 602 in the first DUTY table 600 by the predetermined value, respectively, are set in plural stages.

With such a configuration, when the frequency at which the total consumption current exceeds the setting current is great, e.g., when the punching or the stapling is performed in the image formation, the frequency can be reduced by reducing the DUTY value from the DUTY value 602 in the first DUTY table 600 by the predetermined amount (to the DUTY value in the second DUTY table 603). Thus, by reducing the DUTY value from the DUTY value 602 in the first DUTY table 600, the consumption current of the fixing heater 204 can be increased within the range not exceeding the setting current. Furthermore, the reduction of the above-mentioned frequency eliminates the need of executing the consumption current reducing control. As a result, the temperature of the heating roller 122 can be avoided from lowering with the consumption current reducing control, whereby the degradation of the fixing property and the reduction of the productivity can be overcome.

The frequency at which the total consumption current exceeds the setting current may increase depending on, e.g., not only the types of circuits incorporated in the image forming apparatus and the peripheral devices, but also the type of power distribution environment of the commercial power supply. To deal with such a situation, a DUTY table may be determined in consideration of specific variations in components of the apparatus (machine) in some cases (for example, a usage DUTY value including a predetermined margin may be determined). However, the present disclosure does not require designing the DUTY table including the predetermined margin, and can overcome the problem of specific variations in components, which may arise after starting mass production.

While, in the above-described embodiments of the present disclosure, the number-of-times counting portion 406 counts the number of times of excess N from the start point of the execution of the image formation under the predetermined setting conditions, the number-of-times counting portion 406 may be constituted in a different way. For example, the number-of-times counting portion 406 may count the number of times of excess N during a preset setting period (e.g., 10 sec or 30 sec) from the start point of the execution of the image formation under the predetermined setting conditions. Usually, a tendency of the above-mentioned frequency to increase or decrease can be confirmed from the operation during the predetermined setting period from the start point of the execution of the image formation. Therefore, which one of the first DUTY table 600 and the second DUTY table 603 is to be used in controlling the energization of the fixing heater 204 can be determined from the operation just during the preset setting period.

While, in the above-described embodiments of the present disclosure, the heater control portion 402 controls the energization of the fixing heater 204 just for the predetermined setting time, measured by the measuring portion 408, by employing the modified usage DUTY value 605 after the number of times of excess N has exceeded the setting number of times, the heater control portion 402 may be constituted in a different way. For example, after the number of times of excess N has exceeded the setting number of times, the heater control portion 402 may control, by employing the modified usage DUTY value 605, the energization of the fixing heater 204 for a prolonged setting time (e.g., 1 sec) longer than the above-mentioned setting time by a predetermined time or for a shortened setting time shorter than the above-mentioned setting time by a predetermined time. By prolonging or shortening the setting time, the total consumption current can be held as high as possible corresponding to an increase or a decrease of the above-mentioned frequency.

While, in the above-described embodiments of the present disclosure, the multifunctional peripheral 100 includes the above-mentioned various portions, a program for implementing those portions may be stored in a storage medium and the storage medium may be provided to the user. With such a scheme, the multifunctional peripheral 100 reads the stored program and implements those portions in a software manner. In that case, the program read out from the recording medium provides the advantageous effects of the present disclosure. Moreover, the steps executed by the above-mentioned various portions may be practiced in a manner of storing those steps in a hard disk.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

a fixing device including a heating roller heated by a fixing heater and a fixing roller brought into pressure contact with the heating roller, the fixing device fixing a toner image to a recording medium by the heating roller and the fixing roller;

a DUTY storage portion configured to store a first DUTY table in which DUTY values are set in plural stages, and a second DUTY table in which DUTY values less than corresponding DUTY values in the first DUTY table by a predetermined value, respectively, are set in plural stages;

a heater control portion configured to control the energization of the fixing heater, and, when a total consumption current supplied from a commercial power supply exceeds a setting current, to reduce a consumption current of the fixing heater by controlling the energization of the fixing heater based on the first DUTY table stored in the DUTY storage portion;

a number-of-times counting portion configured to count the number of times the total consumption current has exceeded the setting current;

a number-of-times determining portion configured to determine whether the number of times of excess counted by the number-of-times counting portion exceeds a setting number of times; and a modifying portion configured to cause the heater control portion to control the energization of the fixing heater based on the second DUTY table stored in the DUTY storage portion when the number-of-times determining portion determines that the number of times of excess exceeds the setting number of times, wherein when the number of times of excess exceeds the setting number of times, the modifying portion causes the heater control portion to control the energization of the fixing heater for a setting time by specifying a DUTY value in the second DUTY table, which value corresponds to a currently-used DUTY value in the first DUTY table, and by employing a DUTY value in the second DUTY table, which value is less than the specified DUTY value in the second DUTY table.

2. The image forming apparatus according to claim 1, wherein when the modifying portion causes the heater control portion to control the energization of the fixing heater based on the second DUTY table after start of execution of image formation, the modifying portion causes the heater control portion to control the energization of the fixing heater based on the first DUTY table after completion of the execution of the image formation.

3. The image forming apparatus according to claim 1, wherein, after the lapse of the setting time, the DUTY value used in controlling the energization of the fixing heater is changed to the specified DUTY value in the second DUTY table.

4. The image forming apparatus according to claim 1, wherein the number-of-times counting portion counts the number of times of excess from a start point of execution of image formation, and returns the counted number of times of excess to 0 upon completion of the image formation.

5. The image forming apparatus according to claim 1, wherein the number-of-times counting portion counts the number of times of excess for a preset setting time from a start point of execution of image formation.

6. A control method for a fixing heater in an image forming apparatus that comprises a fixing device including a heating roller heated by the fixing heater and a fixing roller brought into pressure contact with the heating roller, the fixing device fixing a toner image to a recording medium by the heating roller and the fixing roller, the method comprising the steps of:

storing, in a DUTY storage portion, a first DUTY table in which DUTY values are set in plural stages, and a second DUTY table in which DUTY values less than corresponding DUTY values in the first DUTY table by a predetermined value, respectively, are set in plural stages;

causing a heater control portion to control energization of the fixing heater, and further causing the heater control portion to, when a total consumption current supplied from a commercial power supply exceeds a setting current, reduce a consumption current of the fixing heater by controlling the energization of the fixing heater based on the first DUTY table stored in the DUTY storage portion;

causing a number-of-times counting portion to count the number of times the total consumption current has exceeded the setting current;

causing a number-of-times determining portion to determine whether the number of times of excess counted by the number-of-times counting portion exceeds a setting number of times; and causing the heater control portion to control the energization of the fixing heater based on the second DUTY table stored in the DUTY storage portion when the number-of-times determining portion determines that the number of times of excess exceeds the setting number of times, wherein in causing the heater control portion to control the energization of the fixing heater, the heater control portion is caused to control the energization via a modifying portion; and when the number of times of excess exceeds the setting number of times, the modifying portion causes the heater control portion to control the energization of the fixing heater for a setting time by specifying a DUTY value in the second DUTY table, which value corresponds to a currently-used DUTY value in the first DUTY table, and by employing a DUTY value in the second DUTY table, which value is less than the specified DUTY value in the second DUTY table.

7. The control method according to claim 6, wherein when the modifying portion causes the heater control portion to control the energization of the fixing heater based on the second DUTY table after start of execution of image formation, the modifying portion causes the heater control portion to control the energization of the fixing heater based on the first DUTY table after completion of the execution of the image formation.

8. The control method according to claim 6, wherein, after the lapse of the setting time, the DUTY value used in controlling the energization of the fixing heater is changed to the specified DUTY value in the second DUTY table.

9. The control method according to claim 6, wherein the number-of-times counting portion counts the number of times of excess from a start point of execution of image formation, and returns the counted number of times of excess to 0 upon completion of the image formation.

10. The control method according to claim 6, wherein the number-of-times counting portion counts the number of times of excess for a preset setting time from a start point of execution of image formation.

* * * * *